US006289078B1

(12) United States Patent
Snoeren et al.

(10) Patent No.: US 6,289,078 B1
(45) Date of Patent: Sep. 11, 2001

(54) X-RAY EXAMINATION APPARATUS INCLUDING A CONTROL LOOP FOR ADJUSTING THE X-RAY FLUX

(75) Inventors: Rudolph M. Snoeren; Petrus W. J. Linders; Christianus G. L. M. Nederpelt, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/466,410

(22) Filed: Dec. 17, 1999

(30) Foreign Application Priority Data

Dec. 17, 1998 (EP) ..... 98204285

(51) Int. Cl.[7] ..... H05G 1/64
(52) U.S. Cl. ..... 378/98.7; 378/98.8
(58) Field of Search ..... 378/98.7, 98.8, 378/62, 108

(56) References Cited

U.S. PATENT DOCUMENTS

| | | | | |
|---|---|---|---|---|
| 4,517,594 | | 5/1985 | Horbaschek | 358/111 |
| 4,674,108 | * | 6/1987 | Asahina et al. | 378/99 |
| 4,812,903 | | 3/1989 | Wagensonner et al. | 358/80 |
| 5,878,107 | * | 3/1999 | Ishikawa et al. | 378/98.2 |
| 6,044,127 | * | 3/2000 | Van Bree et al. | 378/98.7 |
| 6,047,043 | * | 4/2000 | Kamps | 378/98.7 |
| 6,084,940 | * | 7/2000 | Van Asten | 378/98.7 |
| 6,130,932 | * | 10/2000 | Diepstraten | 378/98.7 |
| 6,198,801 | * | 3/2001 | Dillen | 378/98.7 |

FOREIGN PATENT DOCUMENTS

| | | | |
|---|---|---|---|
| 2135551 | 8/1984 | (GB) | H04B/9/00 |

* cited by examiner

*Primary Examiner*—Robert H. Kim
*Assistant Examiner*—Irakli Kiknadze
(74) *Attorney, Agent, or Firm*—John F. Vodopia

(57) ABSTRACT

An X-ray examination apparatus includes an X-ray source (1) for emitting an X-ray beam, an X-ray detector (6) for detecting an X-ray image and converting it into an optical image, and a video extractor (8) which is coupled to the X-ray detector (6) via optical coupling means (9). The optical coupling means (9) is provided with an optical pick up (11) for feeding a fraction of the light flux to a photosensor (12) which produces a control signal for adjusting the X-ray flux from the X-ray source (1). The photosensor (6) is provided with an array of pixels, with weighting means for the signals detected in or by each of said pixels, and with means for determining a mean value of the detected and weighted signals, yielding a control signal which is fed back in order to adjust the X-ray flux from the X-ray source (1).

13 Claims, 2 Drawing Sheets

X-RAY EXAMINATION APPARATUS INCLUDING A CONTROL LOOP FOR ADJUSTING THE X-RAY FLUX

BACKGROUND OF THE INVENTION

The present invention relates to an X-ray examination apparatus, including an X-ray source for emitting an X-ray beam, an X-ray detector for detecting an X-ray image and converting it into an optical image, and a video extractor which is coupled to the X-ray detector via optical coupling means, the optical coupling means being provided with an optical pick up for feeding a fraction of the light flux to a photosensor which produces a control signal for adjusting the X-ray flux from the X-ray source.

Such an apparatus is known from the International patent application WO 96/20579-A1. The cited document describes an X-ray examination apparatus with an exposure control circuit which supplies a control signal for adjustment of an X-ray source. In case of strongly overexposed areas within a measuring field selected in an X-ray image, the X-ray flux from the X-ray source is reduced by means of said control circuit. In a specific embodiment the signal applied to the exposure control circuit is obtained by means of an optical pick up and a photodetector. The optical pick up and the photodetector, inserted in the collimated beam of the optical coupling means, form a linearly responsive detection unit which carries out the photosensing for X-ray control purposes. As the incorporated photodetector integrates the detected light flux over a selected measuring field, an average value for the X-ray detector output luminance will be found after amplification of the photodetector current. The problem arising in the control loop for the X-ray source is caused highlights, particularly direct radiation on the X-ray detector. As these highlights change in respect of area and amplitude, the control signal from the measuring field is greatly influenced by peak values that may reach values as much as 100 times larger than the signals of interest. The resultant image will be underexposed and relevant image information may be lost.

Depending on the specific applications, a dose from 1 nGy to 10 $\mu$Gy is applied. As already mentioned, with highlights and direct radiation the signal to be detected may vary with a factor 100, so that the photosensor must be sensitive for a signal amplitude range of 5 decades. The dynamic range of the known linear detection unit is then insufficient for pixelized sensors, e.g. CCDs.

Many proposals have been made to cope with this problem, particularly the application of sensor systems in which anatomically determined measuring fields are selected and which are provided with some intelligence to mitigate the consequences of highlights and black areas. In other proposals the optical image obtained by means of a fraction of the X-ray signal is analyzed; on the basis of these analyses the adverse effects of black and extreme white areas are suppressed, after which the examination is performed with full luminance. All of such systems are based on linear detection on a pixel basis; they all involve black and extreme white exclusion in a more or less intelligent way. The detectors are based on a spatially sampled system, i.e. on the basis of pixels, with CCDs.

OBJECTS AND SUMMARY OF THE INVENTION

It is an object of the invention to provide an apparatus as described in the opening paragraph which is simpler and less expensive and in which the adverse effects of the occurrence of highlights and particularly direct radiation are strongly reduced, but accurate X-ray measurements are guaranteed nevertheless.

Therefore, the apparatus in accordance with the invention is characterized in that the photosensor is provided with an array of sensor elements, with weighting means for the signals detected in or by each of said pixels, and with means for determining a mean value signal from the detected and weighted signals, thus yielding a control signal which is fed back in order to adjust the X-ray flux from the X-ray source.

In other words, a control signal from the photosensor will be extracted, within a defined measuring field A, which signal, as a consequence of the weighting process, represents a compressed response to highlights or an expanded response to dark image parts. This control signal will be proportional to the mean value of the weighted signals from the individual pixels, while each of the weighted signals can be represented by $f(E_{ij})$, i.e. a non-linear function of a pixel illuminance value $E_{ij}$.

U.S. Pat. No. 4,674,108 discloses an X-ray examination apparatus, particularly for Digital Subtraction Angiography (DSA), wherein, after a video image is obtained, the video signal is amplified logarithmically for more effective use of the subsequent digital-analog converter. A control signal for the X-ray source is obtained from a video extractor.

Each weighting means in a first embodiment supplies a non-linear (sub-linear) amplified signal whereby, particularly, in each pixel respective weighting means are integrated so as to obtain a non-linear output characteristic of said integrated circuit. Therefore, each pixel includes a photodetector element and a non-linear amplifier element. For example, a pixel may be formed by a photodiode with a non-linear amplifier element such as a FET. In an actual embodiment the photosensor consists of a monolithic two-dimensional array of photodiodes and logarithmic amplifier elements, each of which is coupled to a photodiode. The mean value of the output signals of the logarithmic amplifier elements can be represented by the relation $$S = \frac{S_o}{N}\sum_A \ln\left(\frac{E_{ij}}{E_o}\right)$$

wherein $S_o$ is a suitable conversion factor, $E_o$ a reference illuminance value and N the number of pixels.

The logarithmic amplification will yield ample detector dynamic range. In comparison with the application of linear amplifier elements, the response to highlights and direct radiation is compressed. Upon calibration intended to determine the values of $E_o$ and $S_o$, the detector can measure the encountered illuminance values in an absolute way and in the full range.

The measuring area A can be determined from the image content and hence related to anatomical shapes. In a preferred embodiment, in which the array of pixels is addressable in two dimensions, the possibility is opened for fast sensing of only a few pixels of interest; these pixels are representative of the measuring area A and yield a reliable control signal.

A consequence of the logarithmic output characteristic of the pixels is that the adjustment of the X-ray source is not realized with the same accuracy over the full range of the output signal of the means determining the mean value of the detected and weighted signals. In order to achieve a high and uniform control accuracy, the X-ray examination apparatus is provided with control accuracy enhancing weighting means for converting the mean value signal into a feedback signal for adjusting the X-ray source. More specifically, in the control accuracy enhancing weighting means the mean value signal is processed with a function which is the inverse of the weighting, thus producing a non-linear amplified signal for each sensor element. In the case of a logarithmic pixel output characteristic, the control accuracy enhancing weighting means produce an output signal, which can be represented by the relation $$S_c = ke^{\frac{S}{S_o}}$$

wherein k is a constant. In other words, the latter weighting means yield a linear control signal $$S_c = const.\sqrt[N]{\prod_{i,j} E_{ij}}\ .$$

The output signal of each pixel in a further embodiment is applied to a processor in which the weighting and determination of the mean value of the detected signals are realized on the basis of a program. Every suitable weighting function can be easily applied on the basis of a program. For the exclusion of black or very dark and extreme white areas, a weighting "zero" can be assigned to the respective pixels. After weighting and determination of the mean value of the detected signals, the signals may be subjected to further weighting so as to enhance the control accuracy, particularly so as to obtain a substantially linear control characteristic as mentioned above.

The basic idea of the present invention is applicable not only to an X-ray examination apparatus as described above, wherein the control signal is derived before the video extraction, but also to a type of X-ray examination apparatus wherein the control signal is obtained after video-extraction. Therefore, the application also relates to an X-ray examination apparatus comprising an X-ray source for emitting an X-ray beam, an X-ray detector with a sensor for detecting an X-ray image on the basis of pixels, and a video extractor which is coupled to the X-ray detector and arranged to generate, in response to signals detected in each of said pixels, a control signal for adjusting the X-ray flux from the X-ray source, the video extractor in this X-ray examination apparatus being provided with weighting means for the signals detected in or by each of said pixels, and with means for determining a mean value signal from the detected and weighted signals, which mean value signal forms the basis of said control signal.

As the application of a logarithmic pixel output characteristic is not limited to a control loop for an X-ray examination apparatus, the invention is not limited to such an apparatus, but also relates to a camera system, comprising a detector for detecting an optical image, and a video extractor which is coupled to the detector via optical coupling means, the optical coupling means being provided with an optical pick up for feeding at least a fraction of the light flux to a photosensor which produced a control signal for adjusting the iris and/or the shutter of the camera system. Such a camera system is characterized in that the photosensor is provided with an array of pixels, with weighting means for the signals detected in or by each of said pixels, and with means for determining a mean value of the detected and weighted signals, yielding a control signal which is fed back in order to adjust the iris and/or the shutter of the camera system.

As the signal level is a sub-linear monotonous non-linear function of the individual signal levels, i.e. pixel-values, detected by the individual sensor elements, the effect of very large pixel-values on the control signal is more or less reduced. The more sub-linear the non-linear function, the more the effect of highlights in the x-ray image on the control signal will be reduced. It is to be noted that a sub-linear function is any function which increases as a function of its argument, for at least values of its argument larger than some threshold value, to a lesser extent than any linear function having a fixed rate of increase.

For example, the signal level of the control signal is formed as the geometric mean of the signal levels of the signals from the sensor elements, i.e. the signal level of the control signal $S_c$ is the geometric mean of the pixel values detected by the sensor elements. Thus, there is obtained $$S_c = const\sqrt[N]{\prod_{i,j}^{N} E_{ij}}\ .$$

Another example of a suitable non-linear function to form the signal level of the control signal is $$S_c = const\sqrt[N]{\sum_{i,j}^{N} E_{ij}}\ .$$

Therein, $E_{ij}$ denotes the pixel values at the respective sensor elements.

BRIEF DESCRIPTION OF THE DRAWING

The invention will be described in more detail, hereinafter with reference to the drawings.

FIG. 1 is a diagrammatic representation of an X-ray examination apparatus in accordance with the invention. The X-ray source 1 irradiates, via a beam shaping system 2, an object 3, for example a patient to be examined. An X-ray image is produced on the entrance screen 5 of an X-ray image intensifier 6 by way of the X-ray beam 4 and due to local differences in the X-ray absorption within the object. The X-ray image is converted into an optical image on the exit window 7. In order to pick up the optical image on the exit window 7 and to form an electronic image signal (EIS) therefrom, a video extractor 8 is coupled to the X-ray image intensifier 6 via optical coupling means 9. The optical coupling means are formed, for example, by a lens system which images the exit window onto an image sensor 10 of the video extractor. The electronic image signal (EIS) may be fed to, for example, an image processing system for further processing and, in order to display the information of the X-ray image, to a monitor or hard copy unit.

DESCRIPTION OF THE PREFERRED EMBODIMENTS

Figure 1:
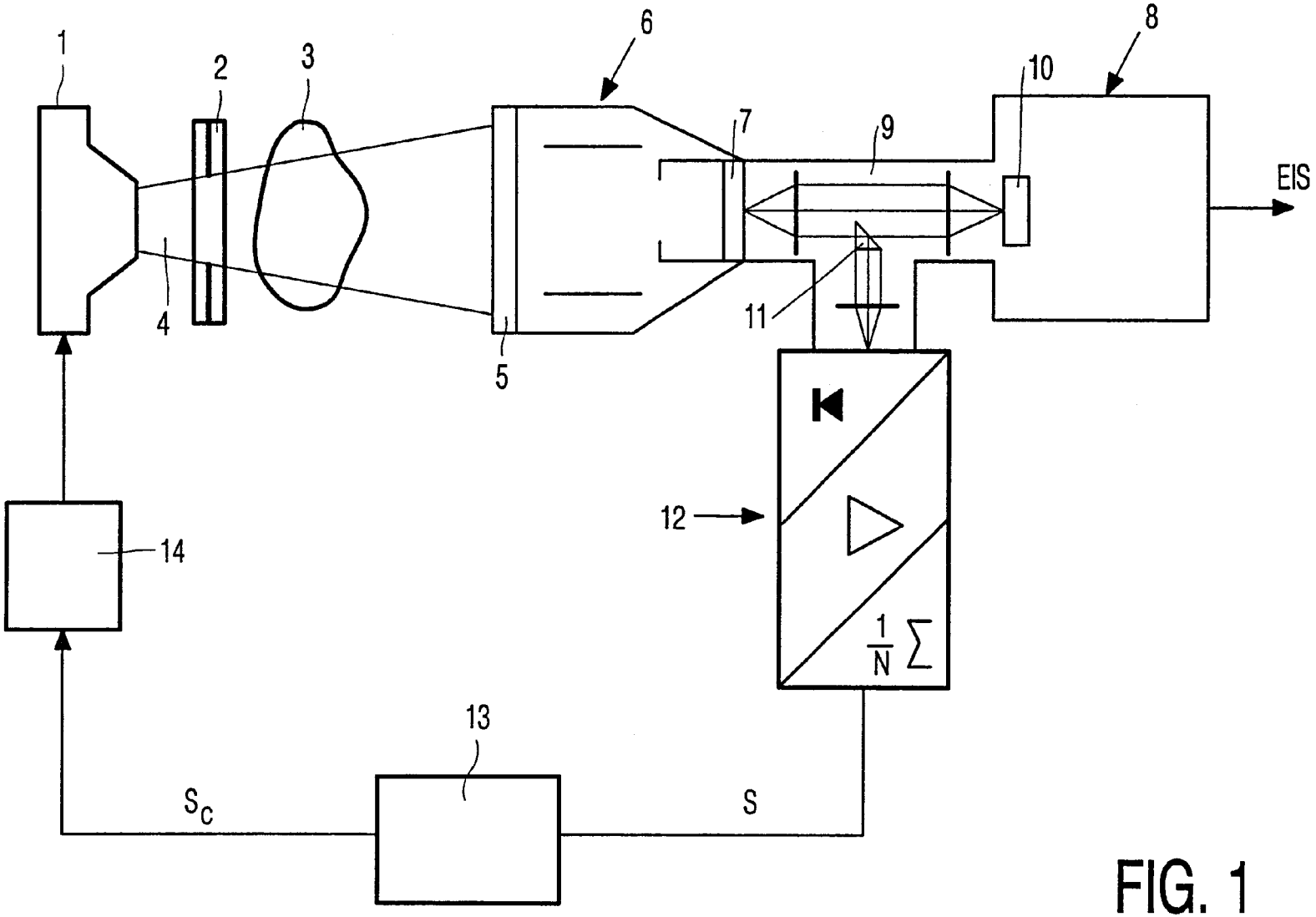
FIG. 1 shows schematically an embodiment of an X-ray examination apparatus according to the invention.

In order to derive a control signal for the X-ray source 1 from the radiance in the optical image on the exit window 7, an optical pick up in the form of a geometrical beam splitter 11, for example a prism, is inserted in the collimated beam of the optical coupling means 9. This beam splitter 11 guides part of the light to a photosensor 12.

The photosensor 12 in this embodiment is formed by a CMOS sensor which consists of a monolithic two-dimensional addressable array of pixels, each pixel comprising a photodiode and a FET having a logarithmic output characteristic and forming a weighting element for the respective photodiode signal. Such sensors are already known from O. Vietze; Active pixel image sensors with application specific performance based on standard silicon CMOS processes, diss. ETH Zürich No. 12038.

As already indicated before, the signal obtained by determining the mean value of the weighted signals from the array of pixels can be represented by the relation $$S = \frac{S_o}{N} \sum_A \ln\left(\frac{E_{ij}}{E_o}\right).$$

The process of determining this mean value is also carried out in the detector 12. The signal thus obtained is applied to control accuracy enhancing weighting means 13 in which the signal S is converted, using an inverse function, into a control signal $S_c$ in accordance with the relation $$S_c = ke^{\frac{S}{S_o}} = const.\sqrt[N]{\prod_{i,j} E_{ij}}$$

wherein k is a constant. After applying this inverse function, the signal $S_c$ obtained is fed back to the high voltage power supply 14 of the X-ray source 1 in order to adjust the intensity and energy of the X-ray beam. Applying this inverse function yields a substantially linear control of the X-ray source, with the result that more accurate control is achieved in comparison with the situation where the signal S is applied directly to the high voltage power supply 14.

Figure 2:
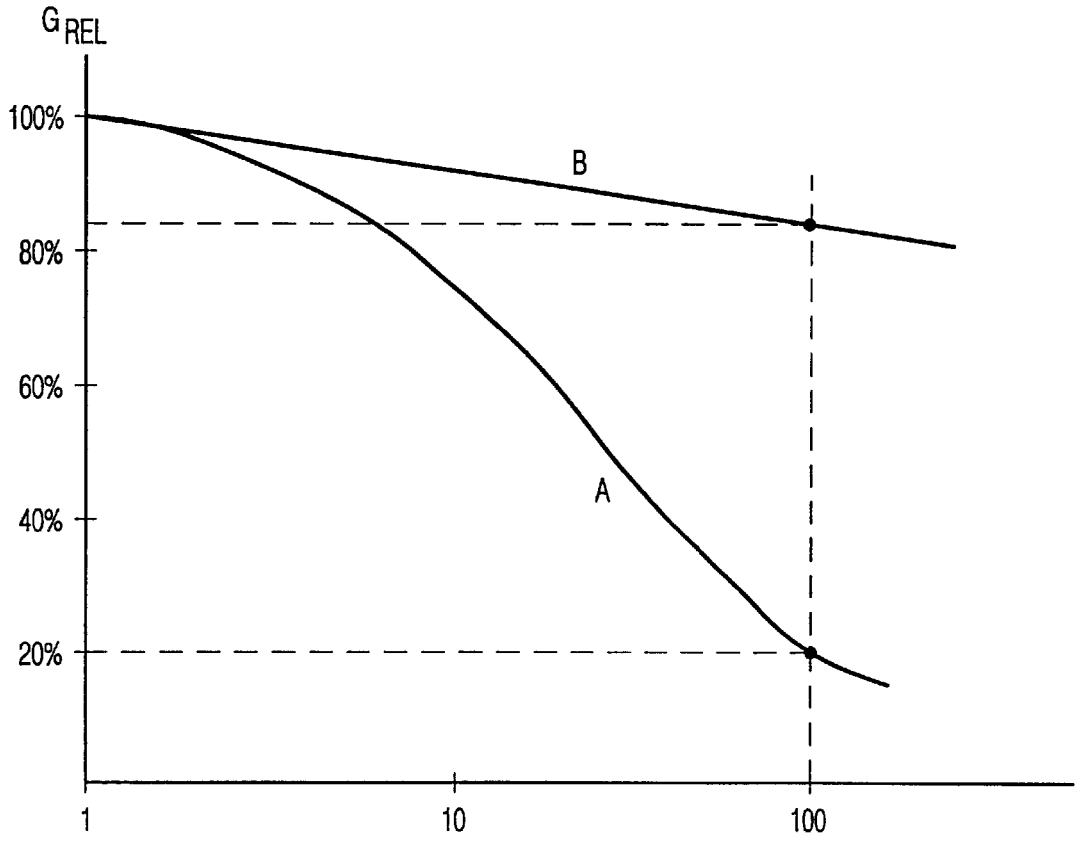
FIG. 2 shows a diagram illustrating the difference between the application of linearly responding detector elements and logarithmically responding detector elements.

Because of the logarithmic output characteristic of the photosensor 12, the response of the detector to highlights forms a logarithmically compressed signal. The influence of highlights and direct radiation is indicated in FIG. 2. The relative gray level $G_{rel}$ of the image of the object after detection is indicated in the vertical direction. In the horizontal direction the object absorption factor is indicated. Without any absorption by the object to be examined, the brightness of the direct radiation is equal to that of the average radiation and $G_{rel}$=100%. In the case of a linear detector and already a comparatively small area (in FIG. 2 an area of 4% of the region of interest is assumed) of highlights and direct radiation, the signal S will be comparatively large so that the X-ray source will be adjusted in the sense that the brightness of the X-ray beam is reduced and hence also the average grey level for the parts of the object to be observed. In the case of an object absorption factor of about 100, $G_{rel}$ diminishes to about 20% and result in reduce image quality (curve A). using the detector according to the invention, this value of $G_{rel}$ is diminished only to about 85% (curve B), as a results of the logarithmic compression of the highlights and direct radiation.

What is claimed is:

1. An X-ray examination apparatus, including an X-ray source (1) for emitting an X-ray beam, an X-ray detector (6) for detecting an X-ray image and converting it into an optical image, and a video extractor (8) which is coupled to the X-ray detector (6) via optical coupling means (9), the optical coupling means (9) being provided with an optical pick up (11) for feeding a fraction of the light flux to a photosensor (12) which produces a control signal for adjusting the X-ray flux from the X-ray source (1), characterized in that the photosensor (6) is provided with an array of pixels, with weighting means for the signals detected in or by each of said pixels, and with means for determining a mean value signal from the detected and weighted signals, thus yielding a control signal which is fed back in order to adjust the X-ray flux from the X-ray source (1).

2. An X-ray examination apparatus as claimed in claim 1, characterized in that each weighting means supplies a non-linear amplified signal.

3. An X-ray examination apparatus as claimed in claim 2, characterized in that in each respective sensor elements there are integrated weighting means so as to obtain an integrated circuit with a non-linear output characteristic.

4. An X-ray examination apparatus as claimed in claim 3, characterized in that individual sensor elements include a photodiode with a non-linear amplifier element such as a FET.

5. An X-ray examination apparatus as claimed in claim 4, characterized in that the photosensor (12) consists of a monolithic two-dimensional array of photodiodes and logarithmic amplifier elements, each of which is coupled to a photodiode.

6. An X-ray examination apparatus as claimed in claim 1, characterized in that the array of pixels is addressable in two dimensions.

7. An X-ray examination apparatus as claimed in claim 1, characterized in that control accuracy enhancing weighting means (13) are provided to convert the mean value signal into a feed back signal for adjusting the X-ray source.

8. An X-ray examination apparatus as claimed in the claim 1, characterized in that the control enhancing increasing weighting means (13) process the mean value signal with a function which is the inverse of the weighting, thus producing a non-linear amplified signal for each sensor element.

9. An X-ray examination apparatus as claimed in claim 1, characterized in that the output signal of each pixel is applied to a processor in which the weighting and determination of the mean value of the detected signals are realized on the basis of a program.

10. An X-ray examination apparatus as claimed in claim 9, characterized in that after weighting and determination of the mean value of the detected signals, the signals are subjected to further weighting so as to enhance the control accuracy, particularly so as to obtain a substantially linear control characteristic.

11. An X-ray examination apparatus, including an X-ray source for emitting an X-ray beam, an X-ray detector with a sensor for detecting an X-ray image on the basis of pixels, and a video extractor which is coupled to the X-ray detector and arranged to generate, in response to signals detected in each of said pixels, a control signal for adjusting the X-ray flux from the X-ray source, characterized in that the video extractor is provided with weighting means for the signals detected in or by each of said pixels, and with means for determining a mean value signal from the detected and weighted signals, which mean value signal forms the basis of said control signal.

12. A camera system, including a detector for detecting an optical image, and a video extractor which is coupled to the detector via optical coupling means, the optical coupling means being provided with an optical pick up for feeding at least a fraction of the light flux to a photosensor which produces a control signal for adjusting the iris and/or the shutter of the camera system, characterized in that the photosensor is provided with an array of pixels, with weighting means for the signals detected in or by each of said pixels, and with means for determining a mean Value of the detected and weighted signals, yielding a control signal which is fed back in order to adjust the iris and/or the shutter of the camera system.

13. An X-ray system, including an X-ray source for emitting an X-ray beam, an X-ray detector with a sensor having a plurality of sensor elements for detecting signals in response to the X-ray beam, a video extractor which is arranged to derive a control signal for adjusting the X-ray source, the control signal being derived from the signals from the sensor elements, characterized in that the video extractor is arranged to derive the control signal in such a manner that the signal level of the control signal is a monotonous sub-linear function of the individual signal levels of the signals from the respective sensor elements.

* * * * *